US005145570A

United States Patent [19]

Jusufbegovic

[11] Patent Number: 5,145,570

[45] Date of Patent: Sep. 8, 1992

[54] PLUG TO SEAL RECESSES FOR ANODE RODS IN ANODE BLOCKS DURING CALCINATION PROCESS

[76] Inventor: Sukrija Jusufbegovic, Mainzer Landstrasse 25 A, D-6257 Elbtal-Elbgrund, Fed. Rep. of Germany

[21] Appl. No.: 634,306

[22] Filed: Dec. 27, 1990

[30] Foreign Application Priority Data

Dec. 28, 1989 [DE] Fed. Rep. of Germany ... 8915209[U]
Jul. 27, 1990 [DE] Fed. Rep. of Germany ..... 4023913

[51] Int. Cl.[5] ..... C25C 3/12; C25C 7/00; B65D 39/00; B65D 43/04

[52] U.S. Cl. ..... 204/279; 204/294; 220/307; 220/352; 220/DIG. 19

[58] Field of Search ..... 204/279, 294, 280, 245; 266/271; 373/71, 72; 220/307, 352, DIG. 19; 138/89, 90

[56] References Cited

U.S. PATENT DOCUMENTS 1,534,316 4/1925 Hoopes et al. ..... 204/245
1,914,409 6/1933 Draper ..... 220/352 X
3,578,200 5/1971 Hetzer ..... 220/307
3,672,973 6/1972 de Nora et al. ..... 204/279 X
4,552,343 11/1985 Labate et al. ..... 373/71 X

FOREIGN PATENT DOCUMENTS 1109904 6/1961 Fed. Rep. of Germany .
1182846 12/1964 Fed. Rep. of Germany .
2235363 2/1973 Fed. Rep. of Germany .
2427190 1/1975 Fed. Rep. of Germany ..... 266/271
2521300 11/1976 Fed. Rep. of Germany .
3206498 9/1983 Fed. Rep. of Germany .

*Primary Examiner*—Donald R. Valentine
*Attorney, Agent, or Firm*—Wenderoth, Lind & Ponack

[57] ABSTRACT

The subject invention is a plug for sealing recesses in anode blocks designed to hold anode rods, wherein the anode blocks are intended for the electrolytic extraction of base metals during their calcination treatment. The proposed plug is characterized by the fact that it is die-formed and composed of a material containing cellulose. This provides a very close seal in the anode recess, such that coke granules, which are inserted as fill material to displace oxygen in gaps between several anode blocks within a calcining furnace, cannot enter the anode recesses. Undesirable conglutination inside the anode recesses and burning of the material defining the anode recesses, caused by the unavoidable presence of some oxygen residue during the calcination process, can no longer occur. Because of the great solidity of the plug, deformations of the recesses in the lower rows of anode blocks in the calcining furnace are prevented. At the conclusion of the calcination process, after the anode recesses are precipitation-hardened, the cellulose containing plugs are carbonized, whereby the coal or ashes remaining in the recesses can be removed by vacuuming, without any difficulty in a subsequent operation.

26 Claims, 3 Drawing Sheets

PLUG TO SEAL RECESSES FOR ANODE RODS IN ANODE BLOCKS DURING CALCINATION PROCESS

BACKGROUND OF THE INVENTION

The invention relates to a plug to seal the openings which are provided to accommodate anode rods in anode blocks, wherein the anode blocks are designed especially for the electrolytic extraction of base metals, such as aluminum, during their calcination treatment.

Base metals such as aluminum, magnesium and alkaline-earth metals are extracted by electrolysis from molten salts which contain the respective metals as cations. The technical production occurs in an electrolytic cell with a pan to hold the melt into which anodes, held by anode rods, are immersed. The anode rods are inserted into recesses of the anode blocks and sealed with molten iron. Lifting devices grip the anode rods to lower the anodes into the molten salt and to raise the spent anode blocks. The anode blocks themselves either consist of coal or a mixture of coke granules and pitch, which is compacted in a form tool and pressed into blocks. During the pressing process the recesses, possibly provided with pulls, are created for the later insertion of the anode rods. The anode blocks, which at this stage of the operation are also called green anodes, are subsequently moved through a cooling track, where they are cooled with water to increase their solidity. Subsequently, the anodes are subjected to calcination in a calcining furnace. To this end the upright anodes are consolidated into bundles—of six, for instance—and positioned by a crane or similar device on the bottom of the furnace. The calcining furnaces are invariably designed to accommodate several such bundles of anode blocks; in one case, for instance, having the capacity to hold a total of 90 anode blocks wherein the upright anodes are appropriately arranged in three rows, one above the other. Calcination should occur in an atmosphere as free of oxygen as possible. For this reason, before the furnace is sealed by a cover, the remaining gaps between the anode blocks are closed with a fill material consisting of coke granules. It has also been tried already to close the openings for the anode rods with plugs before inserting the anode blocks into the furnace. The plugs of the prior art are made of the same material as that of the anode blocks. For the calcining of the anode blocks the furnace is heated to over 800° C. and the treatment lasts about 25 to 30 days. During the calcination process the fill material is unavoidably baked onto, conglutinated and even fused with the anode material. Because of the uneven brick bottom of the calcining furnace, coke granules used as fill material also drop between the anode blocks. The baked-on coke granules on the outside of the anode blocks can be removed by a cleaning machine in a subsequent operation; however, the fill material also enters through the anode-rod openings at the front end of the anode blocks. Consequently, after the calcination process the hollow spaces of the anode openings are not only conglutinated with coke granules but also burned because the atmosphere is not entirely free of oxygen. Moreover, a deformation of the anode openings occurs especially in the lower rows of anode blocks because of the pressure exerted by the higher-placed anode blocks. Consequently, all anodes must be cleaned after the calcination process, whereby the plugs previously inserted to seal the anode openings are chiseled out by pneumatic hammers. Because of the previously discussed conglutination, burning, and the incidence of deformation of the anode holes, the rate of depletion is almost 30-percent, so that an excess of anode blocks must be produced to maintain the continuous operation of an electrolytic cell; for instance, the cryolite electrolytic cell for producing aluminum. In larger aluminum plants the daily production of anode blocks amounts to about 2,000 pieces, so that—assuming an average loss of 27 percent and the cost of producing one anode block to be about DM 1,000.00—the daily loss exceeds half a million German marks.

Using those circumstances as the point of departure, the invention addresses the problem of improving a plug of the type described above in such a way that the plug, despite simpler and cheaper production and easier handling, allows the anode openings to be filled in a basically more form-fitting manner, thereby excluding deposits of coke granules; displacing the oxygen in the hollow spaces to a large extent; and effectively preventing the deformation of anode openings.

To solve the problem, the invention basically proposes that the plug be designed as a die-formed part and consist of material containing cellulose.

The plug of the invention provides a form-fitting seal of the anode openings, so that coke granules used to fill the gaps cannot reach the recesses of the anode blocks. Consequently, conglutination of the anode openings with fill material no longer occurs. Moreover, the extreme form-fitting precision with which the plugs of the invention can be produced out of pressed, cellulose-containing material makes it possible to displace the oxygen in the gaps of the anode openings to a large extent and, consequently, to prevent the occurrence of undesired burns during calcination. These plugs of the invention, made of pressed, cellulose-containing material, exhibit a high degree of solidity, so that deformations of the openings are also avoided for the anode blocks positioned in lower rows within the calcining furnace. Another decisive advantage of the plug of the invention is the fact that at the end of the calcination process, that is after the anode openings are already precipitation-hardened, the cellulose-containing material is carbonized. The charcoal, coal dust or ashes remaining in the anode openings at the end of the calcination process, can easily be vacuumed in a subsequent operation. Thus, with the plug of the invention a smooth operation can be achieved in the production of anodes and, consequently, in the total electrolytic extraction of metal. Aside from easy production, the material used also accounts for the low production cost of the plug.

An initial, special design application of the invention, provides that the plug contain wood shavings, wood fiber or similar wood products.

For another application of the invention the plug may also contain paper, for instance, old or recycled paper.

Depending on geographic location, the invention also allows the plug to be made of shaved or chopped sugar cane residues or to use such material as an additive.

According to the invention the plug may, if appropriate, also contain recycled material as an additive.

From the point of view of production technology, it is particularly advantageous to combine the materials of the plug of the invention with an adhesive substance before pressing, a process which increases the plug's solidity even more.

It is also part of the invention to apply a hydrophobic surface layer of, for instance, clear lacquer to the plug of the invention to increase its shelf life significantly.

According to another concept of the invention the plug is made so that it can be pressed into the applicable recess of the anode block.

According to one application of the invention the external contours of the inserted plug essentially fill the applicable recess completely. For it can happen with special mixtures of the anode material—for instance when using certain types of pitch—that the anode material loses solidity during the calcination treatment, especially if the heating phases are of very long duration, so that deformations could occur in the area of the anode openings, particularly in the lowest rows of anode blocks within the furnace. Another cause of anode-opening deformations is the fact that in case of vibration-induced higher density of the anode material, the anode bulk reaches the higher area of the anode openings less consistently. Extremely high dimensional stability of the anode openings is assured because the plug of the invention essentially fills the applicable recess completely, because said plug has, for instance, at least in part a force fit where its external radial periphery sits in the recess and where the open end of its neck presses against the bottom of said recess.

For easy handling the plug can herein be equipped with a, possibly conical, indentation—extending from the top of the plug in the direction of the plug's neck—for inserting a centering mandrel or a similar centering or loading tool for inserting the plug into the respective anode opening.

The head of the plug is appropriately designed as a collar wherein the external wall surface is basically conically tapered in the direction of the neck. Frequently cylindrical counterbores are incorporated into the anode openings to provide additional support for the subsequent sealing of the anode rods with molten iron. Because of the precise form-fit of the collar in the cylindrical counterbore of the respective anode opening, the plug closes flush with the surface of its collar at one of the external sides of the anode block and thus prevents an accumulation of fill material even in this area. When the plug is inserted into the anode opening the conically-shaped external surface, aside from offering little resistance due to friction, also provides an effective seal.

To facilitate the insertion of the plug even more, its neck, in accordance with the invention, is slightly cone-shaped.

In yet another proposed application of the invention, the neck at it open end exhibits an entrance slant, preferably designed as a bevel, which is particularly advantageous for feeding the plug of the invention automatically into the anode block.

In another design of the invention, the plug, at the open end of its neck and extending in the direction of its top, exhibits a basically centric recess and an indentation, which extends from the upper side of the top in the direction of the neck and is peripherally placed in line with the recess, for stacking plugs one above the other. To provide for easy storage, the plugs of the invention can be stacked in vertical and horizontal rows in a storage container or on pallets to save space and to have them picked up from the warehouse together with the container or on pallets, for transport to a loading facility. Because of the way the plugs are positioned within a stack, a loading tool in one operation can grip several of the plugs, which are arranged in stacks one next to the other, and insert them simultaneously into the anode openings of the anode blocks, which may, for instance, have been consolidated into one bundle. The plugs will generally be produced in the areas where the raw materials needed for their production—that is the cellulose—containing material—are available in sufficient quantities or where they appear as byproducts; this will usually be away from the metal-producing plants. However, because the plugs of the invention are stackable, transportation costs are relatively low. For instance, an internationally standardized container for road, rail, water and air transportation can accommodate about 28,000 of the plugs of the invention, which corresponds to a 15-day supply in one of the larger aluminum plants.

To improve the stability of the plugs when stacked, the invention provides that the indentation, at least in parts, has a contour that corresponds to that of the neck, at least in the area of its open end.

Here it is particularly advantageous when a stacking shoulder is formed within the indentation of the plug.

In another application of the invention, the stackability of the plugs can be optimized if the indentation in the direction of the stacking shoulder tapers conically at an angle of inclination which basically corresponds to that of the neck's bevel at said indentation's radially external periphery.

From the point of view of production technology, it is also particularly advantageous if the indentation is designed to accommodate the centering sheath, or a similar centering or loading tool, for inserting the plug into the respective anode opening.

In accordance with the invention, the neck can be provided with an external thread to assure a particularly firm hold of the plug within the anode opening when needed.

Additional goals, advantages, characteristics and application possibilities of the current invention are apparent from the following description of design applications which is based on the drawings. All herein described and/or figuratively portrayed characteristics are the subject of the current invention either individually or in any desired appropriate combination, irregardless of the way they are combined or referred to in the claims.

BRIEF DESCRIPTION OF THE DRAWINGS

Figure 1:
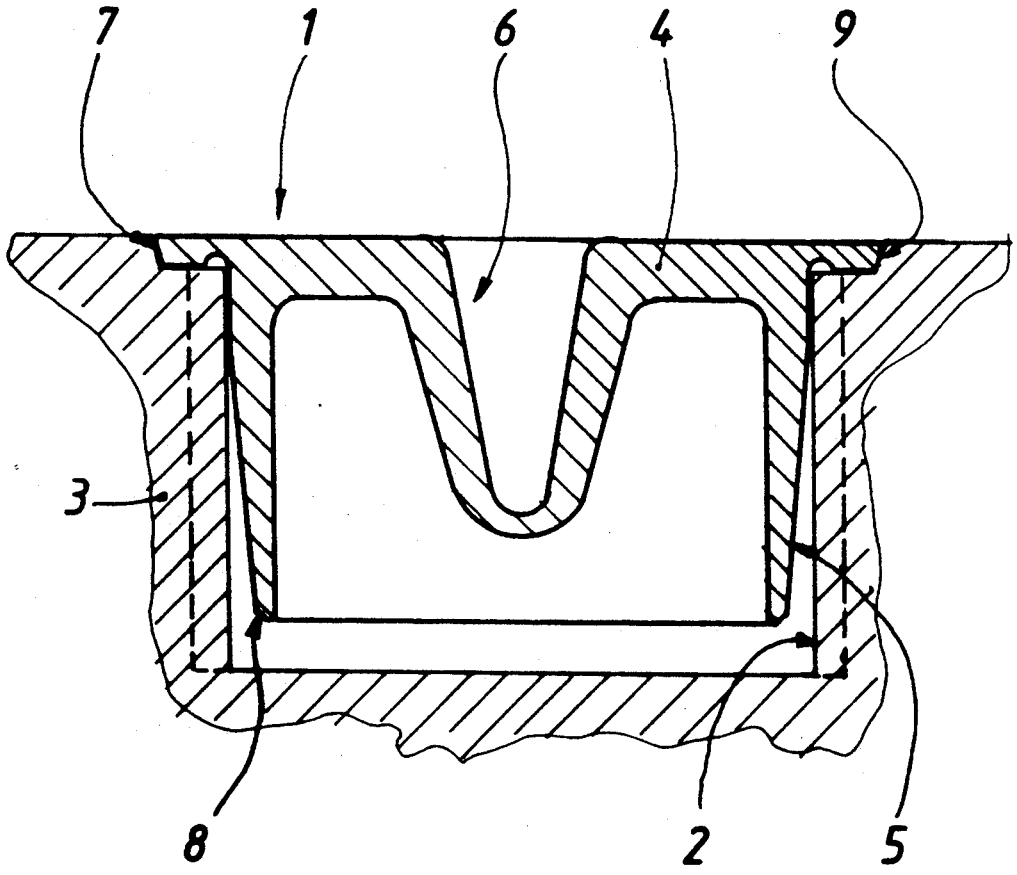
Figure 2:
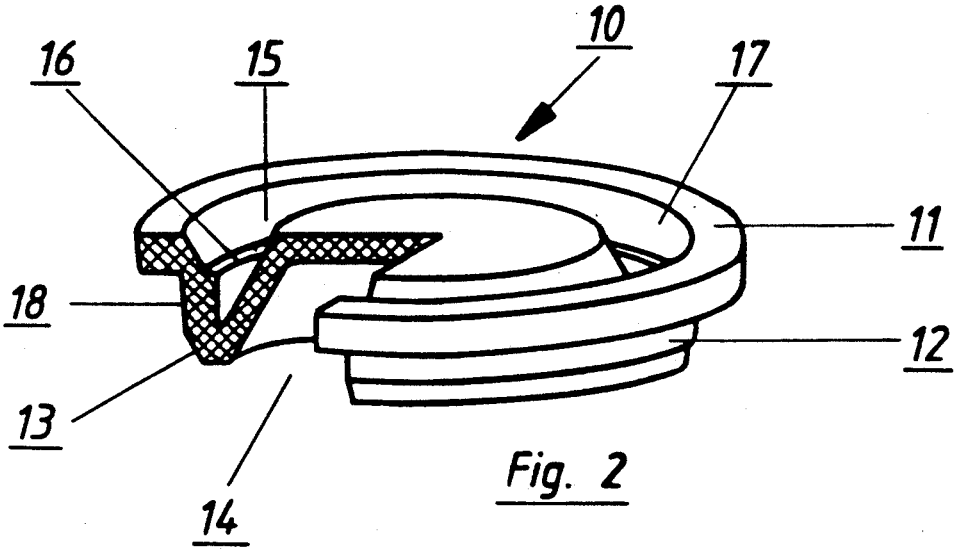
Figure 3:
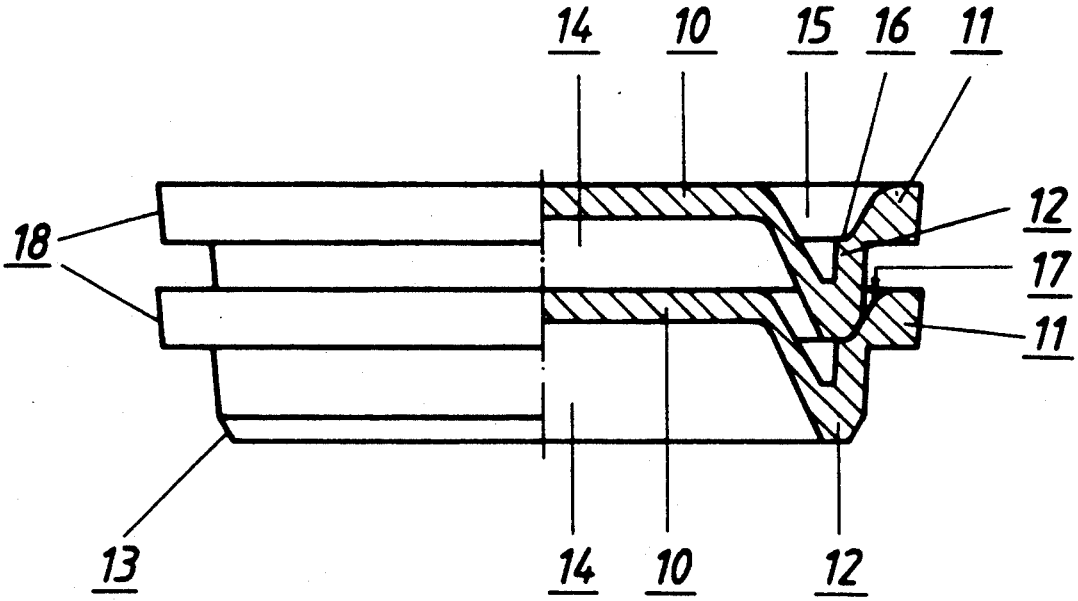
Figure 4:
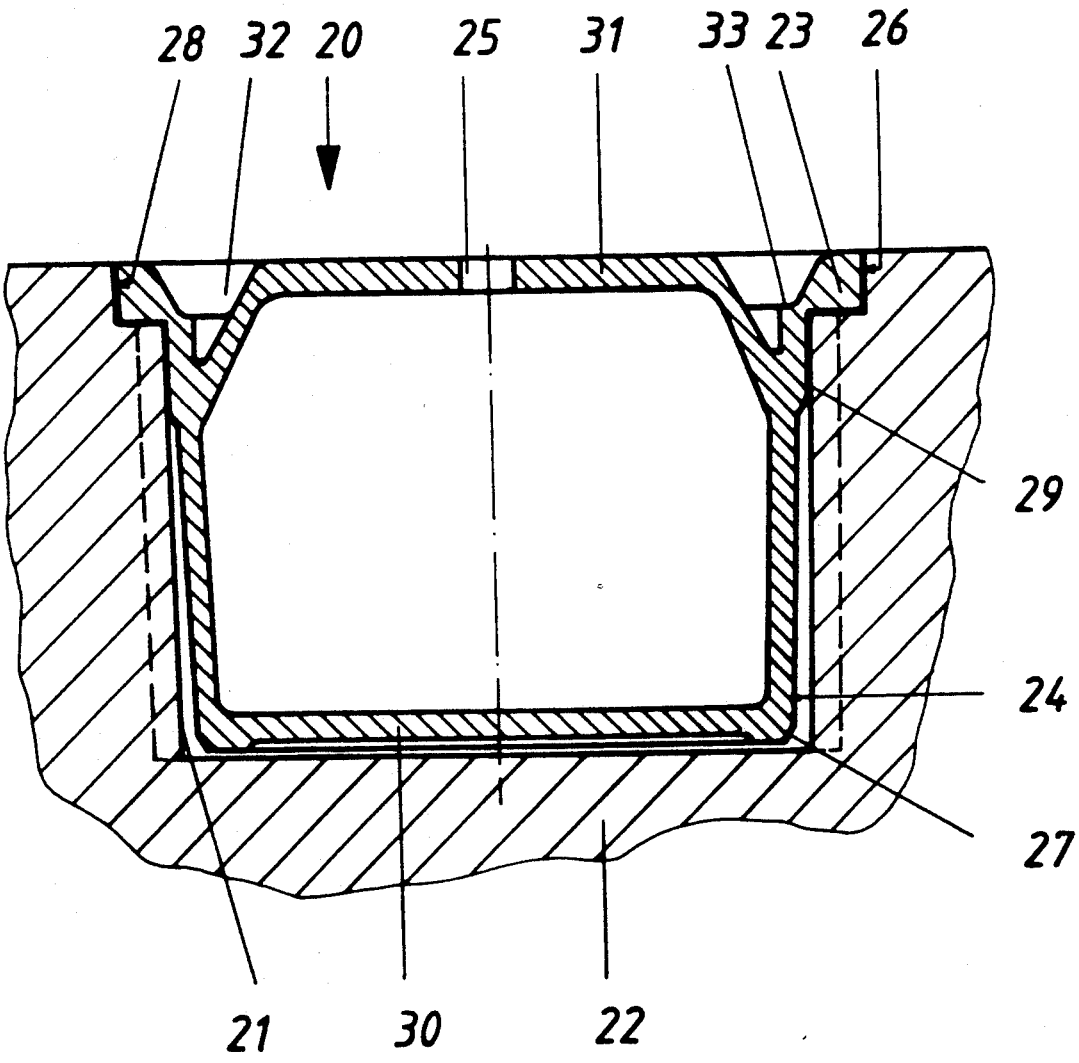

In FIGS.:

FIG. 1 is a sectional view of a possible design of a plug, in accordance with the invention, in its position when inserted into a recess of an anode block;

FIG. 2 is a partially cut away perspective view of a design of a plug, in accordance with the invention;

FIG. 3 is a partially sectional lateral view of the plug shown in FIG. 2, in a stacked position with a second plug;

FIG. 4 is a sectional view of yet another design of a plug, in accordance with the invention, in its inserted position in a recess of an anode block.

DETAILED DESCRIPTION OF THE INVENTION

In FIG. 1, a plug 1 is shown in its pressed-in position in a recess 2 of an anode block 3 which is shown only partially for clarity.

The plug 1 and also plugs 10 and 20 shown in the other figures, are die-formed pieces made of a material containing cellulose. Suitable for this purpose are wood chips, wood fiber, and paper—including old and recycled paper—possibly with the addition of additives such as recycling material. Depending on geographic location, shaved or chopped sugar cane residue may also be used. The cellulose material is mixed with some adhesive, pressed into molds and then, to improve its shelf life, provided with a hydrophobic coat such as sprayed, clear lacquer.

A shown in FIG. 1, a conical indentation 6 is provided for the plug 1, which indentation extends from the top 4 in the direction of neck 5 and which serves to accommodate a centering mandrel, or a similar centering or loading tool, of an automatic loading facility (not shown). By using such a tool, the plug 1 can be pressed mechanically into the recess 2 of the anode block 3 in one automated operation.

In order to achieve a basically flush connection between the plug 1 and the outside of anode block 3, which has the openings of the recesses 2, the top of the plug 1 is formed as a collar 4 which, in the inserted position of plug 1, basically has a precise form fit with a cylindrical counterbore 9 of the anode block 3 in the area of the opening of said recess 2. The collar 4, at the same time, serves as a stop when the plug 1 is pressed in. To provide a seal against the interior surface of cylindrical counterbore 9, the external wall surface 7 of collar 4 tapers conically in the direction of neck 5. This conical exterior wall surface 7, together with a bevel 8 provided at the open end of neck 5, helps to insert and simultaneously center plug 1 automatically into the appropriate recess 2. The slightly conical shape of neck 5 also serves the same purpose.

The plug 1, as well as plug 10 shown in FIGS. 2 and 3, and plug 20 shown in FIG. 4, can be produced with great precision to assure a precise form fit within recess 2. As a result the greatest possible exclusion of oxygen is achieved in the hollow spaces of recess 2 as required by the calcination process. Also as a result, the accumulation of fill material in the recesses 2 is effectively prevented. Moreover, because of the great solidity of the plug 1, deformations of the anode openings 2 cannot occur during the calcination process. Because oxygen unavoidably remains in the hollow spaces of the recesses 2 and also between the adjoining surfaces of the cylindrical counterbores 9 and collar 4 of plug 1, carbonization of the cellulose material of plug 1 occurs at the end of the calcination process (i.e.) after the recesses 2 have already been precipitation-hardened, so that cleaning of the recesses 2 after the calcination of anode blocks 3 can be accomplished easily and quickly by vacuuming the remaining coal or ashes. Fill material—or possibly material from the plug—cannot, therefore, bake on or conglutinate in the recesses 2. Damage during anode production, at least to the extent that it is caused by the plug 1 or its material composition, can be reduced to a minimum.

An added characteristic of the plug 10 shown in FIG. 2 is its stackability, so that, as shown in FIG. 3, a number of such plugs 10 can be securely stacked in one container or on pallets in a space-saving manner.

To this end the plug 10 has a basically centric recess 14 extending from the open end of its neck 12 toward its top 11. On the upper side of top 11 an indentation 15, situated peripherally about the indentation 14, is formed with a stacking shoulder 16. In stacked position the uppermost plug 10 sits with the open end of its neck 12 in the indentation 15 of the plug 10 situated just below the uppermost plug 10, and supports itself on the lower plug's shoulder 16. The indentation 15 in this arrangement tapers conically toward the stacking shoulder 16 wherein the angle of inclination of the indentation's radially external periphery 17 corresponds to bevel 13 of neck 12. Thus, plugs 10 mutually support and stabilize one another within a stack, so that the stack can reach considerable heights without danger of jamming or blocking at the bottom of the stack.

Just as in the design shown in FIG. 1, the top of plug 10 is designed as a collar 11 which in the inserted position of plug 10 fits precisely into a cylindrical counterbore, such as counterbore 9 of anode block 3, in the area of the opening of recess 2. To create a seal against the interior surface of cylindrical counterbore 9 at the opening of the recess 2, the exterior wall surface 18 of collar 11 tapers conically toward the neck 12. The conical exterior surface 18, in conjunction with the bevel 13 at the open end of neck 12, also facilitates the insertion and automatic centering of plug 10 into the appropriate recess 2, wherein—as shown in FIG. 1 for plug 1—neck 12 also has a slightly conical shape.

For the plug 10 shown in FIGS. 2 and 3, the indentation 15 also serves as a center bore for inserting a possibly shell-shaped centering or loading tool of a loading facility (not shown).

Such a loading facility, just like the ones for the plugs in the designs shown in FIGS. 1 and 4, should be designed to accommodate an automatic operation for picking up the number of plugs 10 that corresponds to the number of recesses 2 in the anode blocks 3 which are, for instance, consolidated in a bundle or container during one operational phase, and subsequently closing the openings of the recesses 2 of anode blocks 3 simultaneously by extending the mandrels or centering shells. For the plugs 10 shown in FIGS. 2 and 3, detaching the centering tool from those plugs 10, which are already positioned within the anode recess 2, does not create any technical problems. A stamping device can be contained within the centering shell, which stamping device when extended presses against the upper side of top 11 and thereby pulls the centering shell out of indentation 15.

To assure the uninterrupted production of anodes, an adequate number of plugs 10 are manufactured in advance and, in view of their long shelf life, held in readiness by making optimum use of the container's dimensions for later withdrawal by the loading facility. Because of their stackability the plugs 10 shown in FIGS. 2 and 3 are particularly suitable for this arrangement as well as for shipping in case these plugs 10 are produced in advance at a point geographically removed from the production site for the extractive metallurgy and then shipped in containers by, e.g., ship or rail to their destination.

The plug 20 shown in FIG. 4 is different from plug 1 shown in FIGS. 1 and 2, because its outside walls virtually fill the applicable recess 21 in anode block 22. This assures that deformations of anode openings 21 are avoided if the anode mass consists of special mixtures, which have poor dimensional stability or, for instance, if the calcination treatment has particularly long heating phases. To achieve this goal plug 20 is designed in such a way that the external wall surface 26 of its collar 23 fits precisely into the cylindrical counterbore 28 of recess 21 and such that the plug 20, at least at the sector of the peripheral area 29 of its neck 24 which adjoins collar 23, has a force fit in recess 21. Furthermore, the plug 20 is braced with the open end (or bottom end) of its neck 24 against the base of recess 21. In addition, the plug 20 at the open end of its neck 24 has a bottom part 30 which eventually leads to the stabilization of the anode opening 21 during the calcination treatment.

Just as for the plug shown in FIG. 1, the external wall surface 26 of collar 23 is slightly conically tapered in the direction of neck 24 to provide a seal against the interior surface of cylindrical counterbore 28 of recess 21 and, in conjunction with the bevel 27 provided at the open end of collar 24, to facilitate the automatically-centered insertion of plug 20 into the appropriate recess 21. The neck 24 in its lower regions is also slightly conical. At its top, the plug 20 is sealed by a cover 31 for reasons of stability and to prevent the penetration of fill material. In the center of cover 31 is a center bore 25 for inserting a centering or loading tool of a loading facility (not shown). In addition the cover 31 has a peripheral groove 32 with a stacking shoulder 33, so that here, too, it is possible to stack several plugs 20. Thus, a plug 20 located higher in the stack engages the groove 32 of the next lower plug 20 with the open end of its neck 24 while supporting itself on the lower plug's stacking shoulder 33.

LIST OF PARTS

List of Parts

| | | | |
|---|---|---|---|
| 1 | plug | 17 | peripheral surface |
| 2 | recess, anode opening | 18 | exterior wall surface |
| 3 | anode block | 19 | [not used] |
| 4 | top, collar | 20 | plug |
| 5 | neck | 21 | recess, anode opening |
| 6 | indentation | 22 | anode block |
| 7 | exterior wall surface | 23 | top, collar |
| 8 | bevel | 24 | neck |
| 9 | cylindrical counterbore | 25 | center bore |
| 10 | plug | 26 | exterior wall surface |
| 11 | top, collar | 27 | bevel |
| 12 | neck | 28 | cylindrical counterbore |
| 13 | bevel | 29 | peripheral surface |
| 14 | recess | 30 | bottom |
| 15 | indentation | 31 | cover |
| 16 | stacking shoulder | 32 | groove |
| | | 33 | stacking shoulder |

I claim:

1. An apparatus for sealing a recess formed in an anode block to receive an anode rod during electrolytic extraction of base metals in a calcination treatment, said apparatus comprising:

a plug formed of a material containing cellulose; and wherein said material includes shaved or chopped sugar cane residue.

2. An apparatus for sealing a recess formed in an anode block to receive an anode rod during electrolytic extraction of base metals in a calcination treatment, said apparatus comprising:

a plug formed of a material containing cellulose; and wherein said material includes recycled material as an additive.

3. An apparatus for sealing a recess formed in an anode block to receive an anode rod during electrolytic extraction of base metals in a calcination treatment, said apparatus comprising:

a plug formed of a material containing cellulose; and wherein a hydrophobic layer is formed on a surface of said plug.

4. An apparatus as recited in claim 3, wherein said hydrophobic layer comprises clear lacquer.

5. An apparatus for sealing a recess formed in an anode block to receive an anode rod during electrolytic extraction of base metals in a calcination treatment, said apparatus comprising:

a plug formed of a material containing cellulose; and wherein said plug includes a tool receiving means for receiving a tool for use in inserting said plug in the recess of the anode block.

6. An apparatus as recited in claim 5, wherein said plug includes a top, and a neck extending downwardly from said neck; and said tool receiving means comprises an upwardly opening indent formed in said top of said plug and extending downwardly therefrom.

7. An apparatus as recited in claim 5, wherein said plug includes a top; and said tool receiving means comprises a center bore formed in said top.

8. An apparatus for sealing a recess formed in an anode block to receive an anode rod during electrolytic extraction of base metals in a calcination treatment, said apparatus comprising:

a plug formed of a material containing celulose; and wherein said plug includes a top having a collar formed about a periphery thereof.

9. An apparatus as recited in claim 8, wherein said collar has an exterior wall surface which tapers inwardly and downwardly.

10. An apparatus for sealing a recess formed in an anode block to receive an anode rod during electrolytic extraction of base metals in a calcination treatment, said apparatus comprising:

a plug formed of a material containing cellulose; and wherein said plug has a peripheral collar formed thereabout, a peripheral neck extending downwardly from said collar, an upwardly opening peripheral indentation formed inwardly of said collar, and a downwardly opening central recess formed inwardly of said neck, such that said plug is stackable with other identical plugs.

11. An apparatus as recited in claim 10, wherein said indentation has a cross-sectional contour which is at least partly complementary with a cross-sectional contour of said lower end of said neck.

12. An apparatus as recited in claim 10, wherein a peripheral stacking shoulder is formed on a side wall of said indentation and has a cross-sectional contour which is complementary with a cross-sectional contour of a portion of said lower end of said neck.

13. An apparatus as recited in claim 12, wherein said portion of said lower end of said neck comprises a beveled portion.

14. An apparatus for sealing a recess formed in an anode block to receive an anode rod during electrolytic extraction of base metals in a calcination treatment, said apparatus comprising:

a plug formed of a material containing cellulose;

wherein said plug has a top, and a neck extending downwardly from said top; and wherein external threads are provided about a portion of said neck.

15. An apparatus comprising:

an anode block having a recess formed therein for receiving an anode rod during electrolytic extraction of base metals in a calcination treatment; and a plug formed of a compressed material containing cellulose for sealing said recess in said anode block.

16. An apparatus as recited in claim 15, wherein said material comprises wood chips.

17. An apparatus as recited in claim 15, wherein said material comprises wood fiber.

18. An apparatus as recited in claim 15, wherein said material comprises wood components.

19. An apparatus as recited in claim 15, wherein said material comprises paper.

20. An apparatus as recited in claim 19, wherein said paper comprises recycled paper.

21. An apparatus as recited in claim 15, wherein said material comprises components mixed together with an adhesive and compressed to form said plug.

22. An apparatus as recited in claim 15, wherein said plug and said recess in said anode block are formed such that said plug can be press-fit into said recess.

23. An apparatus as recited in claim 15, wherein said plug has a top and a peripheral neck extending downwardly from said top, said neck having a cross section wherein an outer surface thereof is tapered downwardly and inwardly.

24. An apparatus as recited in claim 15, wherein said plug has a top and a peripheral neck extending downwardly from said top, said neck having a beveled portion at a bottom outer portion thereof.

25. An apparatus as recited in claim 15, wherein said anode block is formed of coal.

26. An apparatus as recited in claim 15, wherein said anode block is formed of coke granules and pitch.

* * * * *